US006511314B2

(12) United States Patent
Johnson

(10) Patent No.: US 6,511,314 B2
(45) Date of Patent: Jan. 28, 2003

(54) DECORATIVE CANDLE AND OIL LAMP ASSEMBLY

(76) Inventor: Susan L. Johnson, 13724 Blackberry Hill La., New London, MO (US) 63459

( * ) Notice: Subject to any disclaimer, the term of this patent is extended or adjusted under 35 U.S.C. 154(b) by 0 days.

(21) Appl. No.: 09/771,655

(22) Filed: Jan. 30, 2001

(65) Prior Publication Data

US 2002/0102509 A1 Aug. 1, 2002

(51) Int. Cl.[7] ..... F23D 3/18

(52) U.S. Cl. ..... 431/321; 431/323; 431/125; 362/181

(58) Field of Search ..... 431/321, 320, 431/125, 126, 288, 289, 291, 323, 322, 324, 325; 362/161, 163, 181, 190, 159

(56) References Cited

U.S. PATENT DOCUMENTS

| | | | | | |
|---|---|---|---|---|---|
| 2,291,072 | A | * | 7/1942 | Dahle | 362/161 |
| 2,481,019 | A | * | 9/1949 | Joyce | 431/289 |
| 3,840,327 | A | * | 10/1974 | Kayne | 431/125 |
| 3,890,085 | A | * | 6/1975 | Andeweg | 431/289 |
| 4,399,494 | A | * | 8/1983 | Perkins | 362/163 |
| 4,511,952 | A | * | 4/1985 | Vanbragt | 362/181 |
| 4,805,076 | A | * | 2/1989 | Menter | 431/320 |
| 5,012,393 | A | * | 4/1991 | Knipe et al. | 362/163 |
| D358,221 | S | * | 5/1995 | Perkins | D26/11 |
| 5,840,257 | A | * | 11/1998 | Bureau et al. | 431/320 |

FOREIGN PATENT DOCUMENTS

| | | | |
|---|---|---|---|
| EP | 0 353 578 | A | * 2/1990 |

* cited by examiner

*Primary Examiner*—Henry Bennett
*Assistant Examiner*—Josiah C. Cocks
(74) *Attorney, Agent, or Firm*—Henry W. Cummings

(57) ABSTRACT

A decorative candle and oil lamp assembly includes a decorative candle including a reduced cross portion, a variety of decorative features, and a circular recess in its top. The oil lamp assembly includes a top, bottom, and body portion. The top portion includes a filler neck with a narrow portion and a flared portion. A flammable liquid, such as lamp oil, is introduced into the oil lamp assembly via the flared portion of the filler neck. Also included in the oil lamp assembly is a wick assembly. The wick assembly includes a glass tube consisting of a straight body portion and a flared portion. Mounted inside the wick assembly is a woven fiberglass wick consisting of a flared upper and a flared lower portion, and a body portion. After the oil lamp assembly is full of lamp oil or other flammable liquid, the wick assembly is placed inside the filler neck, with the bottom flared portion of the fiberglass wick in contact with the flammable liquid.

4 Claims, 2 Drawing Sheets

DECORATIVE CANDLE AND OIL LAMP ASSEMBLY

FIELD OF THE INVENTION

This invention relates to a decorative candle and oil lamp assembly.

BACKGROUND OF THE INVENTION

U.S. Design Pat. Nos. 386,268, 380,856 358,221, 352, 796, 351,034, 350,616, 317,052, 307,638 and 290,046 disclose ornamental designs of oil lamps.

U.S. Pat. No. 4,399,494 (1983), U.S. Pat. No. 3,840,327 (1974), U.S. Pat. No. 2,291,072 (1942), and U.S. Pat. No. 1,295,679 (1919) disclose decorative candle lights In the '494 patent the oil lamp is supported by a hanger suspended from a chimney.

However, in one of these references is the oil lamp supported by a candle having an ornamental design.

SUMMARY OF THE INVENTION

A. Objects

One object of the invention is to provide a decorative candle which supports an oil lamp.

Another object of the invention is to provide an oil lamp designed to fit into a recess in a decorative candle.

Another object of the invention is to make the candle last perpetually.

Another object of the invention is to allow the candle to be illuminated by means of the oil lamp, and thus make the candle last perpetually.

Other objects will be apparent from the following Summary, Description, Drawings, and Claims.

B. Summary

In accordance with the present invention, the decorative candle and oil lamp assembly includes a decorative candle comprising a body, a reduced cross portion, a variety of decorative features, and a circular recess in its top. The oil lamp assembly includes a top, bottom, and body portion. The top portion includes a filler neck with a narrow portion and a flared portion. A flammable liquid, such as lamp oil, is introduced into the oil lamp assembly via the flared portion of the filler neck. Also included in the oil lamp assembly is a wick assembly. The wick assembly includes a glass tube comprising a straight body portion and a flared portion. Mounted inside the wick assembly is a wick preferably made of woven fiberglass, comprising a flared upper portion, a flared lower portion, and a body portion. After the oil lamp assembly is filled with lamp oil or other flammable liquid, the wick assembly is placed inside the filler neck, with the bottom flared portion of the fiberglass wick in contact with the flammable liquid. The entire oil lamp assembly is placed into the circular recess in the decorative candle. A source of combustion (match, lighter, etc.) is placed next to the flared upper portion of the wick, igniting the flammable liquid that has traveled up the wick by osmosis. The resulting flame illuminates the living space around the decorative candle and oil lamp assembly. Since the flammable liquid can be replenished when depleted, and the flame does not depend on wax from the candle for its fuel, the candle will essentially last perpetually.

THE DRAWINGS

DESCRIPTION OF PREFERRED EMBODIMENTS

Figure 1:
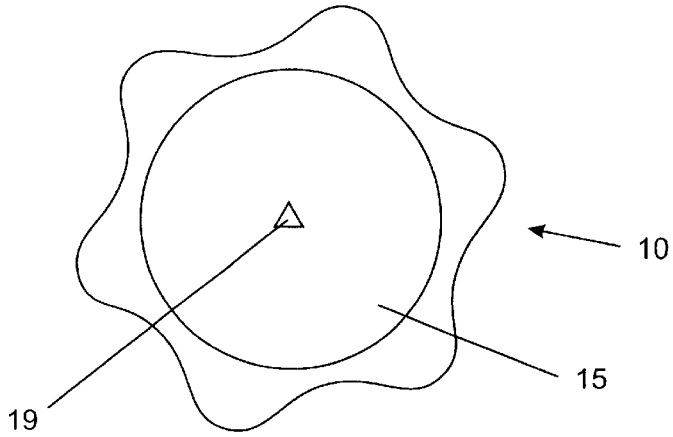
FIG. 1 is a top view of the decorative candle.
Figure 2:
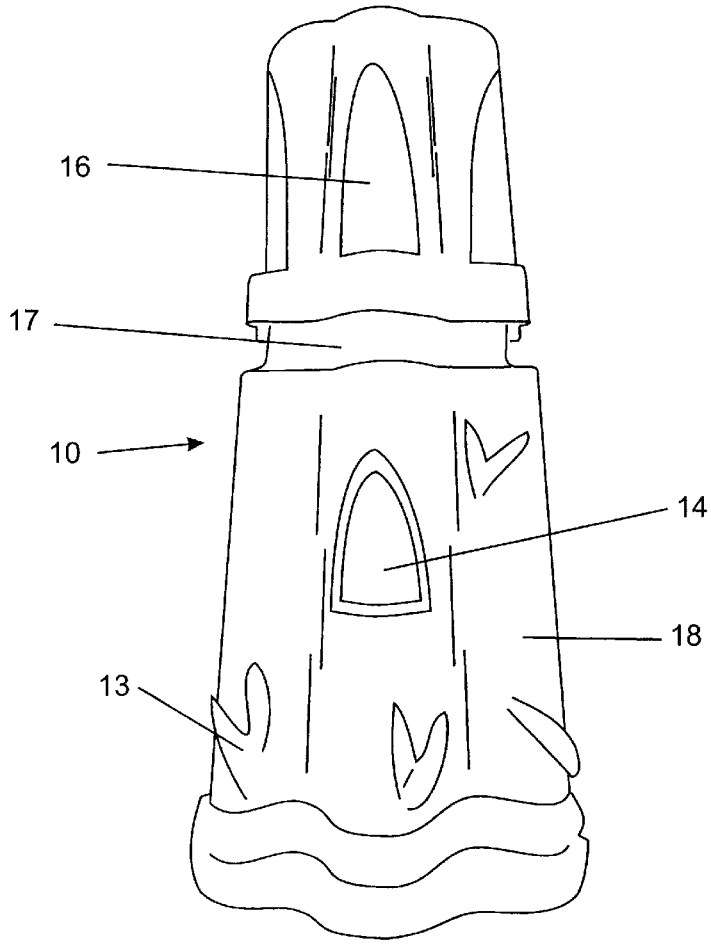
FIG. 2 is a front view of the decorative candle.
Figure 3:
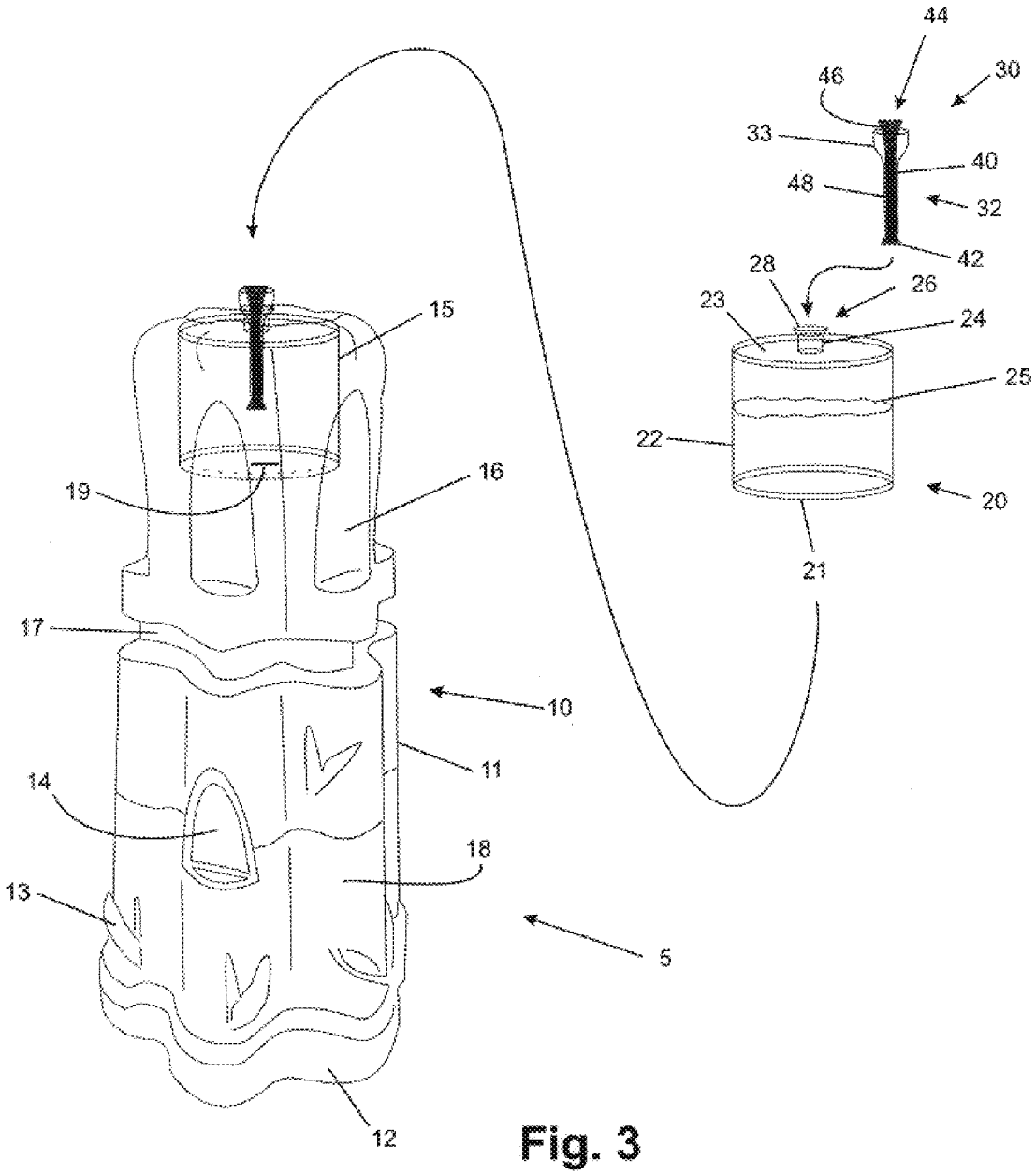
FIG. 3 is a perspective view of the decorative candle and oil lamp assembly, showing the oil lamp assembly both exploded and in its place in the decorative candle.

In accordance with the present invention, the decorative candle and oil lamp assembly 5 includes a decorative candle 10 comprising body 11, reduced cross section 17, a variety of decorative features 12, 13, 14, 16, 18, and circular recess 15. Circular recess 15 is located in the top of decorative candle 10 and is sized to fit the outside diameter of oil lamp assembly 20. Circular recess 15 contains a small depression 19, created as a result of creating the circular recess.

Oil lamp assembly 20 includes top portion 23, bottom portion 21, and body portion 22. Top portion 23 includes filler neck 26 containing narrow portion 24 and flared portion 28. A flammable liquid 25, such as lamp oil, is introduced into the oil lamp assembly via the flared portion 28 of filler neck 26.

Also included in oil lamp assembly 20 is wick assembly 30. Wick assembly 30 includes glass tube 32 consisting of straight body portion 48 and flared portion 33. Mounted inside wick assembly 30 is a woven fiberglass wick 44 consisting of flared upper portion 46, flared lower portion 42, and straight body portion 48. After oil lamp assembly body 22 is full of flammable liquid 25, wick assembly 30 is placed inside filler neck 26, with the bottom flared portion of fiberglass wick 42 in contact with flammable liquid 25. Flared portion 33 of glass tube 32 is larger in diameter than filler neck 26, preventing wick assembly 32 from falling into oil lamp body 22.

What is claimed is:

1. A decorative candle and oil lamp assembly comprising:

a decorative candle including a body, a reduced cross section, various decorative features, and a circular recess located in a top portion of said decorative candle body above said reduced cross section and supporting an oil lamp assembly;

said oil lamp assembly including a bottom portion, a top portion comprising a filler neck, said filler neck comprising a narrow portion and a flared top portion, and provides a means for introducing flammable liquid into a body of said oil lamp assembly; and a wick assembly including a glass tube and woven fiberglass wick;

said glass tube comprising a straight body and a flared upper portion which is larger in diameter than said filler neck, providing a means of preventing the wick assembly from falling into the oil lamp body.

2. A decorative candle and oil lamp assembly according to claim 1 wherein said circular recess contains a small depression in its bottom, as a result of forming the circular recess.

3. A decorative candle and oil lamp assembly according to claim 1 wherein said oil lamp assembly fits into said circular recess in the decorative candle body, holds a flammable liquid, and provides a means for the candle to provide illumination without eroding the candle material.

4. A decorative candle and oil lamp assembly according to claim 1 wherein said woven fiberglass wick comprises a body portion, a flared lower portion, and a flared upper portion, and provides a means to ignite the flammable liquid, resulting in a flame.

* * * * *